US006990818B2

(12) United States Patent
Hofmann

(10) Patent No.: US 6,990,818 B2
(45) Date of Patent: Jan. 31, 2006

(54) DEVICE FOR THE RECONDENSATION, BY MEANS OF A CRYOGENERATOR, OF LOW-BOILING GASES EVAPORATING FROM A LIQUID GAS CONTAINER

(75) Inventor: Albert Hofmann, Karlsruhe (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 129 days.

(21) Appl. No.: 10/758,632

(22) Filed: Jan. 15, 2004

(65) Prior Publication Data

US 2004/0144101 A1 Jul. 29, 2004

Related U.S. Application Data

(63) Continuation-in-part of application No. PCT/EP02/07406, filed on Jul. 4, 2002.

(30) Foreign Application Priority Data

Aug. 1, 2001 (DE) ..... 101 37 552

(51) Int. Cl.
*F25B 9/00* (2006.01)
*F25B 19/00* (2006.01)
*F17C 3/10* (2006.01)

(52) U.S. Cl. ..... 62/6; 62/51.1; 62/48.2

(58) Field of Classification Search ..... 62/6, 62/51.1, 48.2
See application file for complete search history.

(56) References Cited

U.S. PATENT DOCUMENTS

| | | | | |
|---|---|---|---|---|
| 3,179,549 A | | 4/1965 | Strong et al. | |
| 3,670,772 A | | 6/1972 | Ziemek et al. | |
| 4,046,407 A | | 9/1977 | Porreco | |
| 4,223,540 A | | 9/1980 | Longsworth | |
| 4,484,458 A | * | 11/1984 | Longsworth | 62/51.2 |
| 4,570,678 A | | 2/1986 | Ziemek et al. | |
| 5,584,184 A | | 12/1996 | Inaguchi et al. | |
| 5,918,470 A | * | 7/1999 | Xu et al. | 62/51.1 |
| 6,070,414 A | * | 6/2000 | Ross et al. | 62/51.1 |
| 6,192,690 B1 | * | 2/2001 | Stautner | 62/6 |

FOREIGN PATENT DOCUMENTS

EP 0 905 524 3/1999

OTHER PUBLICATIONS

G. Popsecu et al. "A Crtical Review of Pulse Tube Cryogenerator Research", *Int. J. of Refrigeration* 24 (2001) pp. 230-237.

Chao Wang, "Helium Liquefaction With a 4K Pulse Tube Cryocooler", *Cryogneics* 41 (2001) 491-496.

* cited by examiner

*Primary Examiner*—William C. Doerrler
(74) *Attorney, Agent, or Firm*—Klaus J. Bach

(57) ABSTRACT

In a device for the re-condensation of low-boiling gases evaporating from a liquid gas container having a tubular neck in which a cold head of a cryo-generator is supported, the cold head includes a pulse tube with a heat exchanger and a cold area having an annular projection extending into an annular recess formed in a heat transfer ring mounted in the tubular neck in closely spaced relationship with the walls of the annular recess so as to provide a gas passage therethrough and permitting relative axial movement between the cold head and the liquid gas container.

10 Claims, 4 Drawing Sheets

DEVICE FOR THE RECONDENSATION, BY MEANS OF A CRYOGENERATOR, OF LOW-BOILING GASES EVAPORATING FROM A LIQUID GAS CONTAINER

This is a Continuation-In-Part application of international application PCT/EP02/07406 filed Jul. 4, 2002 and claiming the priority of German application 101 37 552.2 filed Aug. 1, 2001.

BACKGROUND OF THE INVENTION

The invention relates to a device for the re-condensation of low-boiling gases evaporating from a liquid gas container by means of a cryo-generator. With such a device for example a superconductive magnet which is cooled by immersion into liquid helium can be operated over an extended period by re-condensation of the helium evaporated. The device is a small refrigeration apparatus, a so-called cryo-cooler. In a similar way, such a device is used in connection with a superconductive magnet of high-temperature superconductive material which is cooled by immersion into liquid nitrogen.

Below the present state of the art is described shortly (see also FIG. 4):

The cryo-container 1 consists of an inner container 2, which is filled with the low-boiling liquid gas, for example, liquid helium, up to a level 7. The superconductive apparatus, typically a magnetic coil 5 including the power supply lines 6*a*, 6*b* is immersed into the liquid gas. The helium evaporating as a result of the heat supplied to the container 2 is conducted, by way of a narrow tube 8, to the ambient or rather to a collecting container. For reducing the heat influx, the helium container 2 is surrounded by an enclosure 3 and the space between the inner container 2 and the outer enclosure 3 is evacuated. For further reducing the heat influx, a radiation shield 4 is arranged in the vacuum space between the container 2 and the enclosure 3. The radiation shield 4 is cooled by the helium gas by way of a contact ring 10 disposed on the tube 8. On one hand, the tube 8 should be as narrow as possible in order to reduce the heat influx but, on the other hand, if, accidentally, the magnet becomes suddenly normally conductive, the tube 8 should have a sufficiently large cross-section to permit the discharge of the additional gas generated in order avoid in that case an excessive pressure increase in the container 2.

When the helium level has dropped below a certain height the helium must be replenished from a transport container. This requires substantial efforts and expenditures.

There are small cooling devices (cryo-generators) by which the helium evaporating from the helium bath can again be liquefied and returned directly to the cryo-container. Some of these devices have two- or several stages and provide sufficient cooling energy for the cooling of radiation shields. The most important embodiments of such cryo-generators are presently the pulse tube cooler and the Gifford-McMahon cooler.

As far as this is possible with such low temperature cooling apparatus such a cryo-generator should be easy to handle, uncomplicated in its operation and easy to service. The low temperature-boiling gases used in these cooling apparatus are helium, He, Hydrogen $H_2$; Neon, Ne; nitrogen, $N_2$ which are also used in the superconductor technology as coolants.

A cryo-generator consists basically of cooling equipment with a so-called cold head. This cold head is mounted outside onto the apparatus and extends into the tube 8 down to the container 3 for the liquid gas. There, the cold area 26 is exposed to the liquid level 7 of the liquid gas. The single-stage cooling apparatus is so designed and installed that it can be removed and re-installed without heating the liquid gas. The cold head comprises a regenerator 21 and a pulse tube 23 with a heat exchanger 25 disposed therebetween. The heat exchanger 25 is embedded in the cold area 26, which is exposed toward the liquid gas bath.

The components regenerator 21, pulse tube 23 are surrounded each by a thermally isolating enclosure/heat shield (20, 30, 31, 32) in order to prevent thermal coupling to the outside or at least to maintain it within acceptable limits.

The cooling apparatus that is the cold head may be of different design, but it includes generally at least two stages. It also extends into the tubular neck 8 and its last stage cold area 28 is disposed above the liquid gas bath. Also, such a multistage cold head can be removed and re-installed without heating the liquid gas bath. Each stage of the cold head consists of a regenerator 21, and, respectively, 22 and a pulse tube 23 and, respectively, 24, with a heat exchanger 25 and, respectively, 27 disposed therebetween. Each heat exchanger is contained in a cold area 26 or, respectively, 28. The cold area of the last stage extends with its exposed surface into the cold vapor space of the liquid gas container 2. The components, the regenerator 21 and respectively, 22, the pulse tube 23 and respectively, 24 of the respective stage are, like in the single stage embodiment, each surrounded by a thermally insulating tube 29, 30, 31, 32. All the cold areas 26, except for the last one, are disposed in the direction toward the next following stage co-axially opposite a heat transfer ring 10, which is disposed at the respective location in the tubular neck 8 in good heat transfer relationship. The respective cold head area 26 extends in an axially movable manner, with a small equidistant gap around the circumference, into the associated heat transfer ring 10, without coming into contact therewith at any point. In this way, there is always a gas passage open from the vapor space above the liquid gas bath to the flange of the cold head. The multistage cooling apparatus extending into the tubular neck 8, which is mounted onto the flange cover 33 that is bolted onto a connector flange 9 of the corner wall 3, can expand axially as a result of thermal effects without restrictions.

It is the object of the present invention to provide an improved device for the re-condensation of low boiling gases evaporating in a liquid gas container.

SUMMARY OF THE INVENTION

In a device for the re-condensation of low-boiling gases evaporating from a liquid gas container having a tubular neck in which a cold head of a cryo-generator is supported, the cold head includes a pulse tube with a heat exchanger and a cold area having an annular projection extending into an annular recess formed in a heat transfer ring mounted in the tubular neck in closely spaced relationship with the walls of the annular recess so as to provide a gas passage therethrough and permitting relative axial movement between the cold head and the liquid gas container.

Preferably, the thermally isolating shield 20, 30, 31, 32 consists of a layer which is disposed on the respective component and consists of a material which has a low heat conductivity and which prevents or severely limits axial and radial heat transfer.

Thermal insulation is provided by an evacuated space extending from end to end of an envelope. To this end, the respective component is surrounded by a thin-walled cylindrical tube with low heat conductivity which, because of its shape or a support structure, remains so stiff that the exterior pressure—that is generally the ambient pressure, in fault situations such as sudden transition of the immersed coil from a superconductive to a normally conductive state generating excess pressure—cannot move the cylindrical tube into contact with the envelope wall over an extended area. Preferably, also the support structures which stiffen the outer wall of the vacuum space consist of a material with low heat conductivity. The support structure may include a rope wound helically around the component from the top to the bottom or vice versa. In place of such a continuous rope, rope sections may be provided on the circumference of the component which are not in contact with one another. Other measures known from the state of the art of insulation engineering may also be used if applicable.

In another effective way of providing a vacuum chamber, the outside wall of the vacuum chamber is a thin-walled corrugated tube whose inner open diameter is slightly larger than the component disposed within so that, if contacts are formed, they are established only as short line contacts with the outer wall of the component. Such a chamber may also be formed by a thin-walled tube which has projections or line-like reinforcements so that contacts can be provided only in spots or over short lines.

The outer wall of the vacuum chamber may furthermore consist of a thin-walled corrugated tube which has an inner open width which is also slightly larger than that of the one which is surrounded thereby and is held in spaced relationship by rod elements which helically surround the component or by axial rods disposed in circumferentially spaced relationship on the component.

For a low-resistance gas flow particularly during a fault each of the cold areas 26 is provided with at least one bore 37*a* or more bores 37*a* uniformly distributed over the circumference.

The advantages of the device according to the invention obtained as a result of the design features disclosed will be described below with reference to the accompanying drawings.

DESCRIPTION OF THE ARRANGEMENTS OF THE INVENTION AND THE ADVANTAGES THEREOF

Figure 1:
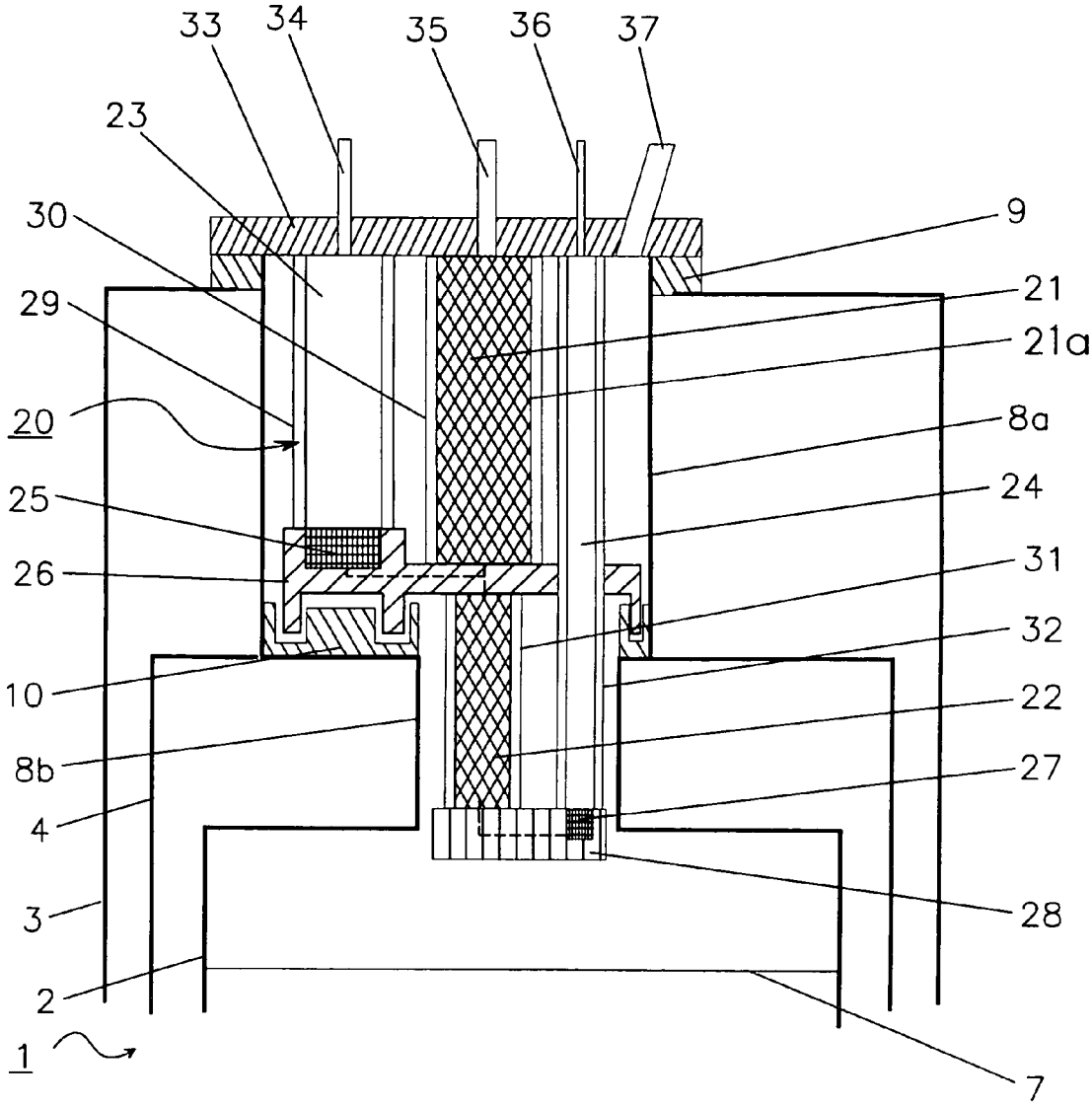
Fig. 1 PRIOR ART
FIG. 1 shows a device for the re-condensation of low boiling gases with a cryo-generator including two pulse tube coolers.

FIG. 1 shows schematically the construction of the cold head of the two-stage pulse tube cooler and its installation in a cryostat. The pulse tube cooler and its components are only shown to the extent they are needed for an understanding of the invention.

The two-stage cooler consists of the regenerator 21 with a connecting line 37 to a compressor which is not shown and which supplies the pulsating gas flow. The pressure varies typically between about 10 bar and 25 bar. At the other end of the regenerator, the gas flow is divided so that a first partial flow is admitted through the first heat exchanger 25 to the first pulse tube 23. At the opposite end thereof, a second gas flow is admitted by way of the connection 34. With suitably adjusted values and a time shift of these gas flows a cooling effect is achieved in the area of the heat exchanger 25 providing for a refrigeration output. With this refrigeration output, the radiation shield 4 is cooled down to a first temperature level, which is already substantially below the ambient temperature. For the thermal coupling of the radiation shield 4 to the location of the refrigeration output the heat transfer device 26 comprises a structure with good heat conductivity, the so-called first cold area 26. At the side adjacent the heat transfer ring 10 which is connected to the tubular neck 8, the first cold area 26 has a circumferentially toothed structure and the heat transfer ring 10 has a complementary structure. This toothed structure is so designed that at the interface areas which extend in the figure vertically between the cold area 26 and the transfer ring 10 a very narrow gap remains which is filled with the gas evaporating in the container. On the other hand, the tooth engagement is such that a displacement in the vertical direction is possible. In this way, on one hand, a good thermal coupling is achieved and, on the other hand, relative displacement as it occurs for example with different thermal expansions and contractions, is possible.

Furthermore, the cold head can be removed and re-installed when necessary without heating the cryostat.

The second partial flow of gas out of the first regenerator 21, which has an intermediate temperature, is conducted, by way of the second heat transfer structure 27, into the second pulse tube 24 to which, by way of the gas conduit 36 at the upper end thereof, also a pulsating gas flow is supplied. In this way, in the area of the second heat transfer structure 27, the temperature is further reduced. Such coolers are in accordance with the state of the art so constructed that at the first stage a first temperature reduction in the range of 30° K and 100° and in the second stage a cooling energy with a much smaller temperature reduction in a temperature range of 5° K which is available for the condensation of helium is available. If the second heat exchanger 27 is embedded into the second cold area 28, which is a second heat conductive structure also with good heat conductivity and a large surface area on the side of the evaporating helium, the helium evaporating in the container 2 can be condensed and it can return to the bath disposed below.

Because of the method of operation of the cooler with a pulsating gas stream, the temperature varies slightly in each operating cycle at the surfaces subjected to the internal pressure. In the pulse tubes 23 and 24, this effect is particularly pronounced. With the temperature change at the side adjacent the evaporating helium a locally limited expansion of this gas occurs. This however, results in a movement of the gas in the whole container neck formed by the tubes 8*a* and 8*b*. As a result, there is a heat flow from the warm upper support flange 33 to the cold gas space 7, which is undesirable. There is furthermore an additional effect, which results from the different temperature distributions in the regenerators and the pulse tubes. As a result, these components may have different temperatures at the same level. This unavoidably results in a natural convection, which may also cause a detrimental heat transport.

Figure 2B:
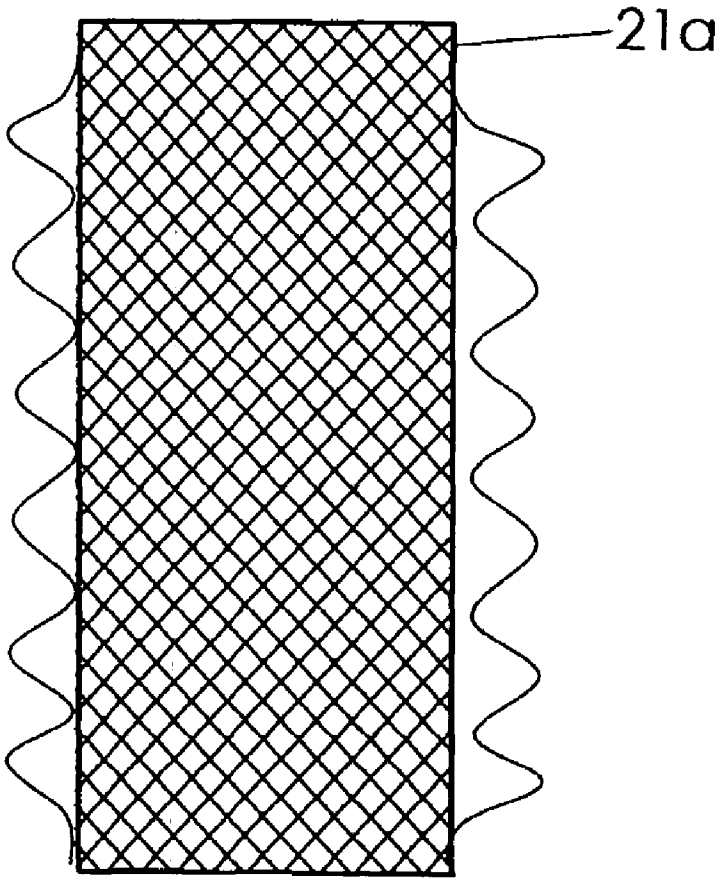
FIG. 2*b* shows the pulse tube disposed in a corrugated hose for ensuring a certain spacing.
Figure 2A:
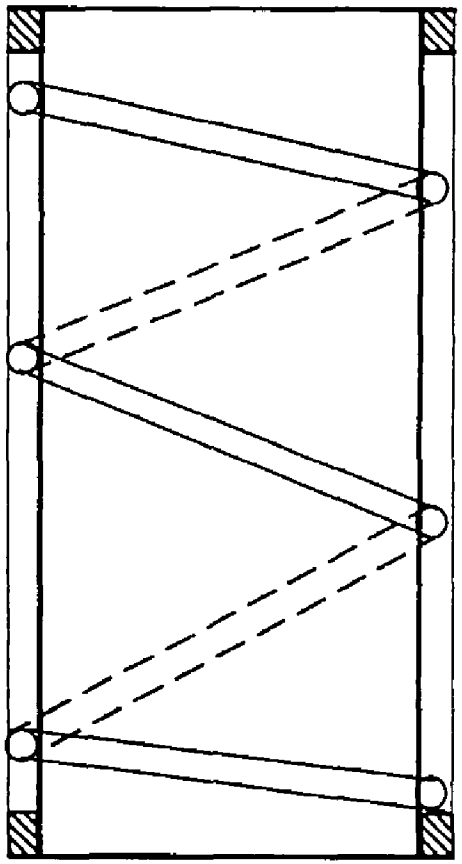
FIG. 2*a* shows a rope wound helically around a pulse tube cooler tube for ensuring a certain spacing.

Both effects are avoided if both regenerators 21, 22 and both pulse tubes 23, 24 have thermally insulated walls 29 to 32. The pulse tubes 23, 24 can be insulated by enclosing them in a layer of plastic which has a low heat conductivity or by providing an evacuated intermediate space that is a vacuum chamber. The numeral 30 designates the thermally insulating tube 29 surrounding the first regenerator, 29 designates the tube surrounding the second regenerator and 32 the tube surrounding the second pulse tube. It is however a disadvantage that through the wall of such a thermally insulating tube an additional heat flow to the respective cold end is established. In order to reduce this effect, the insulating tube must be as thin-walled as possible. However, if the wall is too thin, the tube may be bulged inwardly because of the external pressure effective thereon. The measures schematically shown in FIGS. 2*a* and 2*b* help to avoid such bulging. FIG. 2*a* shows an example of such a component with the larger diameter, that is for the regenerator 21, wherein the tube 30 is provided with a support structure disposed on the inner tube 21*a* for stabilizing the tube. A second solution is shown in FIG. 2*b*. In this case, the thin-walled tube is in the form of a corrugated tube. If the open width of this corrugated tube is slightly greater than the outer diameter of the inner tube, only point-like contacts with negligible heat transfer bridges can form. These tubes may be permanently sealed or they may be connected to communication lines leading to a vacuum pump.

Under normal operating conditions, the helium gas assumes within the tubular neck 8*a* and 8*b* a stationary temperature distribution without internal connection and the connecting line 37 is closed. Only when the pressure in the gas space exceeds a predetermined value because of a fault, the exhaust gas line 37 is opened for example by way of a pressure relief valve. If it is necessary to release a large amount of gas, the body 26 at the first cold area may be provided with bores 37*a* which facilitate the discharge of gases from the lower neck part with the surrounding wall 8*b* into the part with the surrounding wall 8*a*.

Figure 3:
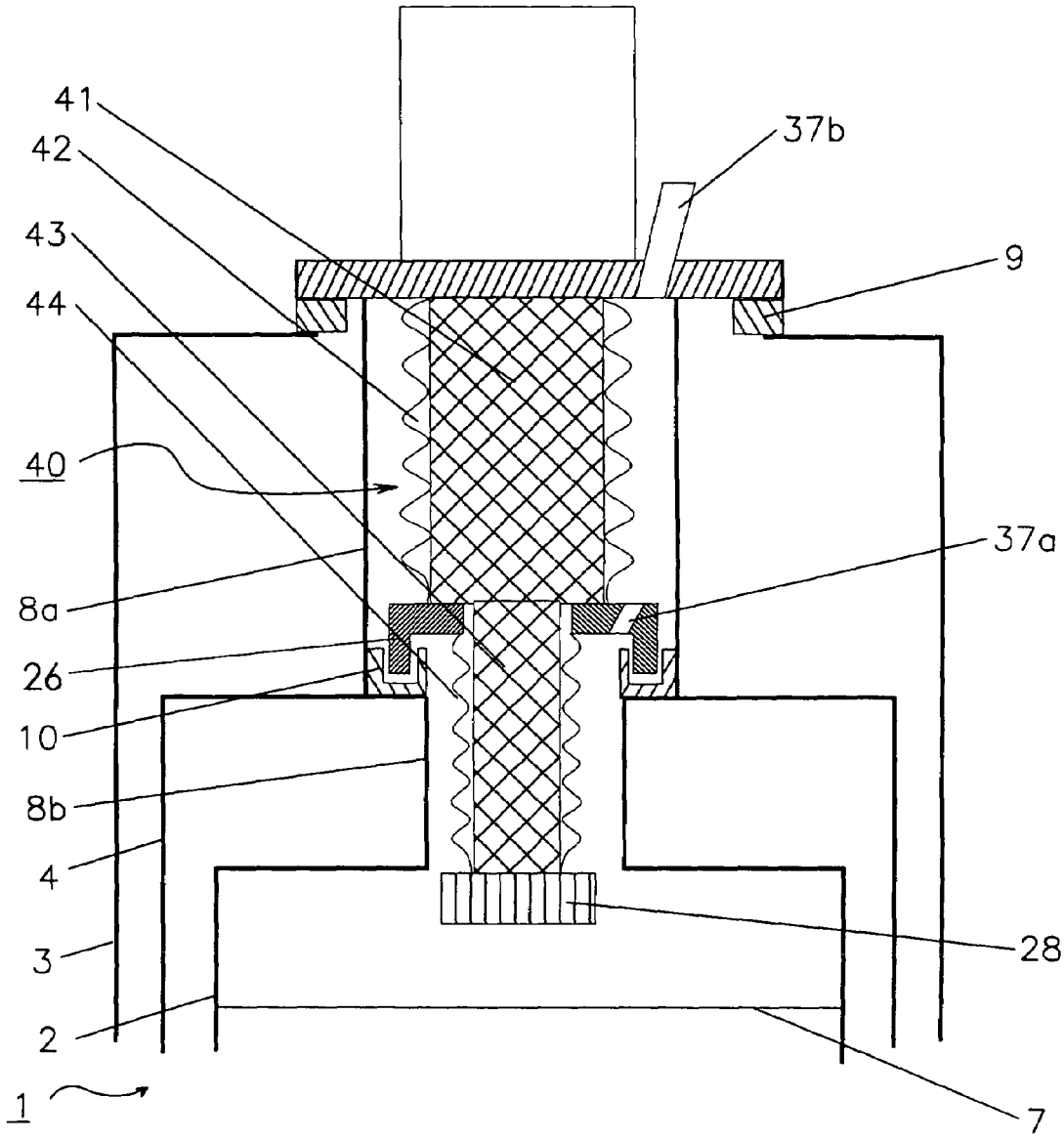
FIG. 3 shows the arrangement with two McMahon coolers.
Figure 4:
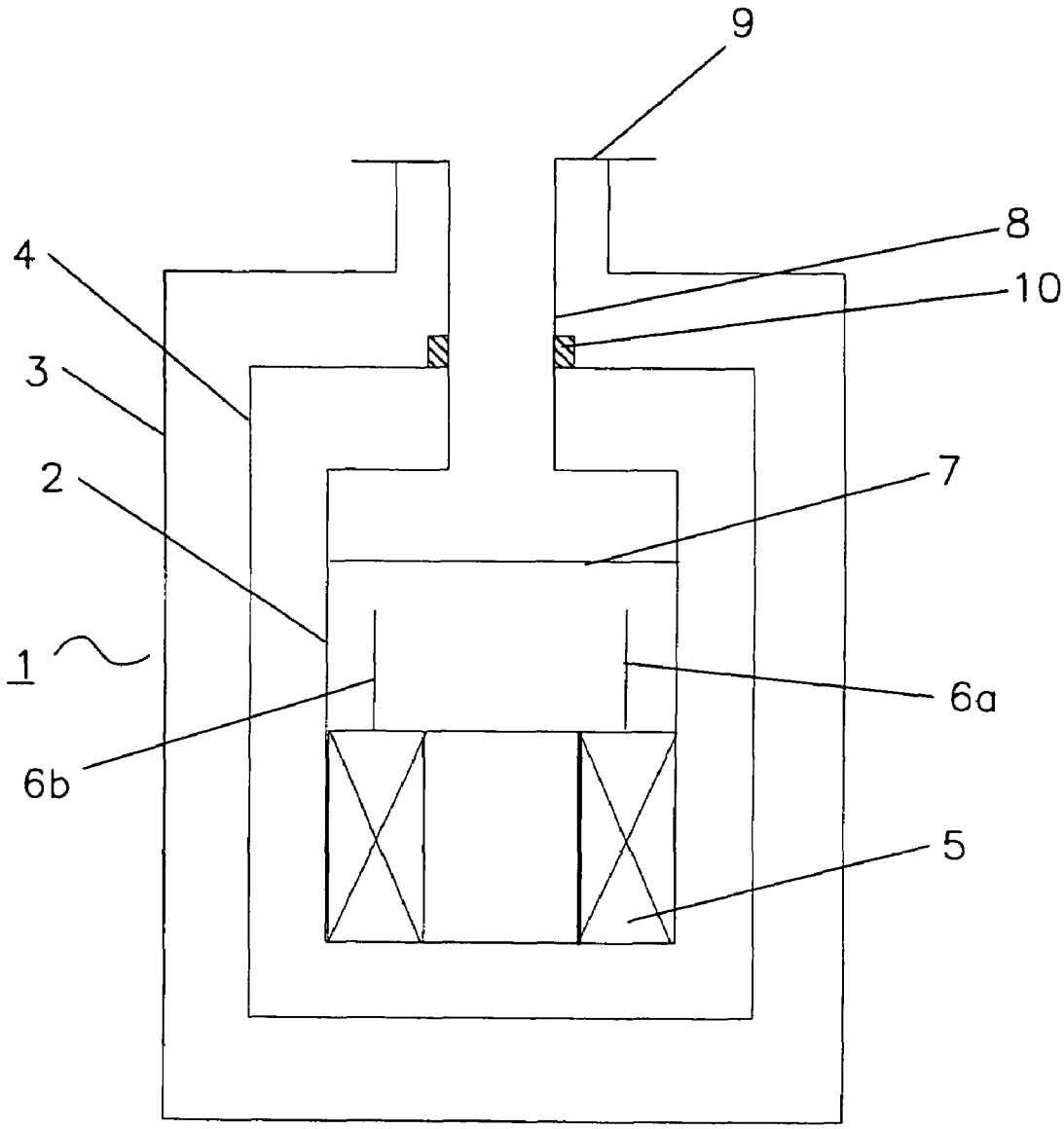
Prior Art Fig. 4
FIG. 4 shows the diagram of a cryostat.

FIG. 3 shows schematically the important components of the Gifford McMahon cooler for helium re-condensation, specifically the analog solution for a two stage Gifford McMahon cooler. The first stage is formed by a circular structure 41. Its lower front end surface forms the first cold area 26. The following second cylinder 43 with smaller diameter forms the second stage. The pressure pulsations in the interior of these cylinders 41, 43 and the movement of the regenerators result in temperature changes at the outer walls. To avoid the undesirable heat flow caused thereby the wall surfaces of both cylinders should be thermally insulated. In the representation of FIG. 3, a corrugated tube structure 42, 44 is shown for that purpose. The other solutions described above can also be used in connection with the Gifford McMahon cooler.

What is claimed is:

1. A device for the re-condensation by means of a cryogenerator of low boiling gases evaporating from a liquid gas container (2) having a tubular neck (8) with an end flange and extending from said end flange into said liquid gas container and having at its end in said gas container a cold area (26), a cooling device, a so-called cold head, comprising a regenerator (21) and a pulse tube (23) with a heat exchanger (25) disposed therebetween supported on said tubular neck (8), said heat exchanger (25) being contained in said cold area (26), said regenerator (21) and said pulse tube (23) of said cooling device being each surrounded by a thermally insulating heat shield (29, 30, 31, 32) forming a vacuum chamber extending around said liquid gas container (2) and having an outer wall consisting of a thin-walled tube, which is provided with stiffening means so as to be able to withstand the ambient pressure, a heat transfer ring (10) arranged in said tubular neck (8) and having an annular recess, said cold area (26) having annular projections extending into said annular recess in said heat transfer ring (10) in spaced, relationship with the walls of said recess, whereby a gas passage from the vapor space above the liquid gas both in said container to the cooling device is provided, and said cold head and said tubular neck (8) are axially movable relative to each other to permit different thermal expansions.

2. A device according to claim 1, wherein said cooling device has at least two stages disposed in said tubular neck (8) of said liquid gas container (2), each having a cold area (26, 28), which is removable and re-installable without the need for heating the liquid gas bath, each stage of said cooling device consists of a regenerator (21) or (22) with a heat exchanger (25, 27) disposed there-between, each of said heat exchanger (21) including a cold area (26, or respectively, 28), the cold surface (28) of the last stage has an exposed surface extending into the cold vapor space of said liquid gas container (2), said regenerator (21) and said pulse tube (23, 24) of the various stages of said cooling device are surrounded each by a shield of a thermally insulating material (20, 30, 31, 32), all cold areas except for the last one, are disposed toward a subsequent stage adjacent a heat transfer ring (10) supported in the tube neck (8) at a particular location in a good heat transfer position therewith, and a cold area (28) extends into an annular recess in the heat transfer ring (10) so that they are equidistantly spaced from the recess wails thereof and do not touch said walls, whereby a gas passage from the vapor space above the liquid gas bath to the beginning of the first cooling stage exists, and said cold head extending into said tubular neck (8) which is supported on said flange (33) mounted on the container wall (3) and each can expand thermally without coming into contact therewith.

3. A device according to claim 1, wherein said heat shield 20, 30, 31, 32 consists of a material with low heat conductivity.

4. A device according to claim 1, wherein said stiffening means consist of a material with low heat conductivity.

5. A device according to claim 4, wherein said stiffening means is a rope wound helically around the outer wall of said vacuum chamber.

6. A device according to claim 4, wherein said stiffening means are rope sections disposed on the outer wall of said vacuum chamber of a line.

7. A device according to claim 1, wherein said outer wall comprises a thin-walled corrugated tube whose inner open diameter is slightly larger than that of the component surrounded thereby so that, if contact is established between said corrugated tube and the component surrounded thereby, such contact is only point-like or at most over a short length of a line.

8. A device according to claim 1, wherein said outer wall (29, 30, 31, 32) is a thin-walled tube provided with indentations or line-like reinforcement areas projecting toward the component surrounded by the thin-walled tube.

9. A device according to claim 7, wherein said elements of a material with low heat conductivity are disposed on the component surrounded by said thin-walled corrugated tube in order to maintain a predetermined gap between said thin-walled corrugated tube and the component surrounded thereby.

10. A device according to claim 1, wherein each cold area (28) is provided with at least one bore (37*a*) evenly distributed around the circumference to permit gas flow through said cold area (26).

* * * * *